US009607788B2

(12) United States Patent
Hintz et al.

(10) Patent No.: US 9,607,788 B2
(45) Date of Patent: Mar. 28, 2017

(54) COMPACT CONTAMINATION RESISTANT PUSH BUTTON SWITCH

(71) Applicant: ILLINOIS TOOL WORKS INC., Glenview, IL (US)

(72) Inventors: Michael K. Hintz, Waukesha, WI (US); Jonathan H. Olson, Sussex, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/902,472

(22) PCT Filed: Jul. 9, 2014

(86) PCT No.: PCT/US2014/045882
§ 371 (c)(1),
(2) Date: Dec. 31, 2015

(87) PCT Pub. No.: WO2015/009497
PCT Pub. Date: Jan. 22, 2015

(65) Prior Publication Data

US 2017/0004938 A1 Jan. 5, 2017

Related U.S. Application Data

(60) Provisional application No. 61/847,208, filed on Jul. 17, 2013.

(51) Int. Cl.

| | |
|---|---|
| ***H01R 24/00*** | (2011.01) |
| ***H01H 13/18*** | (2006.01) |
| ***H01H 13/06*** | (2006.01) |

(52) U.S. Cl.
CPC ..... *H01H 13/183* (2013.01); *H01H 13/06* (2013.01)

(58) Field of Classification Search
CPC .. H01R 13/701; H01R 13/703; H01R 13/183; H01H 9/08
USPC ..... 200/51 R, 51.11; 68/12.26
See application file for complete search history.

(56) References Cited

U.S. PATENT DOCUMENTS

| | | | | |
|---|---|---|---|---|
| 6,753,489 | B2 * | 6/2004 | Kiyono et al. ..... | H01H 21/282 200/200 |
| 2006/0005997 | A1 | 1/2006 | Kim et al. | |
| 2009/0064723 | A1 | 3/2009 | Kim | |
| 2013/0015049 | A1 | 1/2013 | Tengler et al. | |
| 2014/0124342 | A1 | 5/2014 | Osvatic et al. | |

FOREIGN PATENT DOCUMENTS

| | | |
|---|---|---|
| DE | 7305417 U | 5/1973 |

OTHER PUBLICATIONS

ISR and WO for PCT/US2014/045882 mailed Oct. 20, 2014.

* cited by examiner

*Primary Examiner* — Vanessa Girardi

(57) ABSTRACT

An appliance switch provides contacts protected within a housing that may fit coaxially within and behind a pushbutton of the switch. The pushbutton includes a rearwardly extending arm that actuates an operator extending from a rear edge of the switch as installed avoiding a water path into the contact assembly.

17 Claims, 3 Drawing Sheets

COMPACT CONTAMINATION RESISTANT PUSH BUTTON SWITCH

CROSS-REFERENCE TO RELATED APPLICATIONS

This application is a National Phase of PCT/US2014/045882 filed Jul. 9, 2014 and claims the benefit of U.S. Provisional Application 61/847,208 filed Jul. 17, 2013.

FIELD OF THE INVENTION

The present invention relates to a compact electrical switch having a pushbutton operator that is resistant to environmental water and other contaminants.

BACKGROUND OF THE INVENTION

Modern appliances such as frontloading washing machines or dryers may provide for lid or door switches detecting when the appliance lid or door is open. These lid switches turn off the appliance to allow the user unhampered access to the clothing in the machine and to protect the consumer from machinery moving inside the appliance. Such switches may provide a button extending from the housing of the appliance to be activated by closing of the door, the latter which presses the button inward into the housing.

The switch operator may slide within an outer sleeve that provides for mechanical support to the switch operator guiding it in axial translation when the switch operator is pressed by the door. The sleeve may conform closely to an outer surface of the switch operator both to prevent the ingress of contaminants into the housing and to prevent camming or jamming of the switch operator as it is pressed inward by the door. The sleeve may be stationary with respect to the housing and therefore sealed to the housing.

Contaminants such as water, bleach, fabric softener and detergent that are blocked by the close fit between the sleeve and the switch operator may nevertheless accumulate and dry on the outer surface of the switch operator that protrudes from the housing when the door is open. Such contaminants can cause the switch operator to jam within the sleeve when it is retracted therein potentially allowing operation of the appliance even when the door is open.

US patent publication 2014/0124342, assigned to the assignee of the present invention, and hereby incorporated by reference, describes a switch pushbutton that is supported not by an outer sleeve but by an inner post removed from accumulating contaminants. By allowing the outer sleeve a clearance from the pushbutton, at least when the pushbutton is pressed in, inward jamming of the pushbutton is avoided.

The pushbutton may further communicate with contacts positioned to the side of the pushbutton away from direct exposure to moisture.

SUMMARY OF THE INVENTION

The present invention provides a pushbutton switch that is both more compact and which better resists contamination in the laundry environment or the like. This is accomplished by placing the switch mechanism within the post providing a support for a pushbutton. In this way, the switch mechanism is protected from the contamination to which the switch operator is exposed without the need for offset contacts that may provide additional water barriers.

In one embodiment, the invention provides an appliance switch having a frame with a faceplate with an opening in it and longitudinal extent having a periphery that may be received along a horizontal axis through a hole in a vertical wall of an appliance with a rear surface of the faceplate abutting a front surface of the vertical wall. A pushbutton is supported by the frame within the periphery to move between an on and off position with respect to the frame along the horizontal axis through the opening in the faceplate as received. A contact housing fits within the periphery behind the pushbutton along the horizontal axis, and an electrical contacts assembly is supported within the contact housing to be shielded by the contact housing from water directed downward across the contact housing or inward through the faceplate as received. The pushbutton includes an arm member extending from the pushbutton along the outside of the contact housing to a rear lower portion of the contact housing as received and the contact housing exposes an operator communicating between the electrical contact assembly and a distal portion of the arm member to activate the electrical contact assembly with movement of the pushbutton.

It is thus a feature of at least one embodiment of the invention to provide a water resistant, compact appliance pushbutton that may be installed through an appliance wall. By placing the contacts within a supporting post, the contacts are both protected from water and may fit within a narrow form factor for installation through a wall opening.

The pushbutton may be supported away from contact with the opening in the faceplate when the pushbutton is fully pressed in toward the faceplate.

It is another feature of the invention to provide a pushbutton that resists being jammed in an activated position by contaminants that may accumulate on the outer surfaces of the pushbutton. By supporting the pushbutton with a center column, greater outer clearances may be provided between the pushbutton and the faceplate.

The pushbutton may include rearwardly extending walls providing a continuous surface from a front end of the pushbutton exposed through the opening of the faceplate throughout a range of motion between the on and off position, and a front of the contact housing fits within rearwardly extending walls of the pushbutton when the pushbutton is fully pressed in toward the faceplate.

It is thus a feature of at least one embodiment of the invention to provide the present design benefits in a reduced-depth pushbutton by allowing the pushbutton to press in over the contact housing.

The inner surface of the rearwardly extending walls may contact an outer surface of the contact housing to guide motion of the pushbutton as it moves between the on and off position.

It is thus a feature of at least one embodiment of the invention to support movement of the pushbutton without the need for guidance by a surrounding sleeve susceptible to contamination and jamming The appliance switch may include a spring positioned between a front surface of the contact housing facing the pushbutton and a rear surface of the pushbutton facing the contact housing.

It is thus a feature of at least one embodiment of the invention to provide a compact switch assembly suitable for installation through a wall opening by employing an in-line compression spring.

The spring may be a conical spring.

It is thus a feature of at least one embodiment of the invention to minimize the depth of the compressed spring to provide the benefits of the present invention in a reduced-depth switch assembly.

The pushbutton may further include a stop interacting with the frame at a point removed from the faceplate to limit outward motion of the pushbutton.

It is thus a feature of at least one embodiment of the invention to limit outward motion of the pushbutton without the need for features abutting the faceplate such as might adhere in the presence of contamination.

The outer surface of the pushbutton maybe frusto-conical to taper inward as one moves away from the contact housing.

It is thus a feature of at least one embodiment of the invention to provide reduced clearance when the button is in the extended position to reduce ingress of contamination without risking sticking of the button in the closed position.

The operator may present a wedge outer surface pressed upward with rearward motion of the button as received.

It is thus a feature of at least one embodiment of the invention to provide an operator exposed and moving in a vertical direction to limit water ingress.

The appliance switch may further include forwardly extending cantilevered arms attached at a rear of the framework to extend outside of the periphery in an un-flexed state and to flex within the periphery as the framework is received through the hole in the vertical wall of the appliance, the forwardly extending cantilevered arms flexing outward to abut a rear surface of the vertical wall of the appliance when the frame is installed in the hole in the vertical wall.

It is thus a feature of at least one embodiment of the invention to provide a simple mechanism for installing in the appliance through the use of a flexible snap-type restraint.

The rearwardly extending walls of the pushbutton may prevent inward flexing of the cantilevered arms except when the pushbutton is fully extended.

It is thus a feature of at least one embodiment of the invention to provide a more compact outer periphery of the appliance switch by providing an overlapping of structures that need not occupy the same space at the same time.

The frame, pushbutton, contact housing, and operator may be constructed of thermoplastic.

It is thus a feature of at least one embodiment of the invention to provide an assembly that is compatible with high moisture environments.

Other features and advantages of the invention will become apparent to those skilled in the art upon review of the following detailed description, claims and drawings in which like numerals are used to designate like features.

Figure 1:
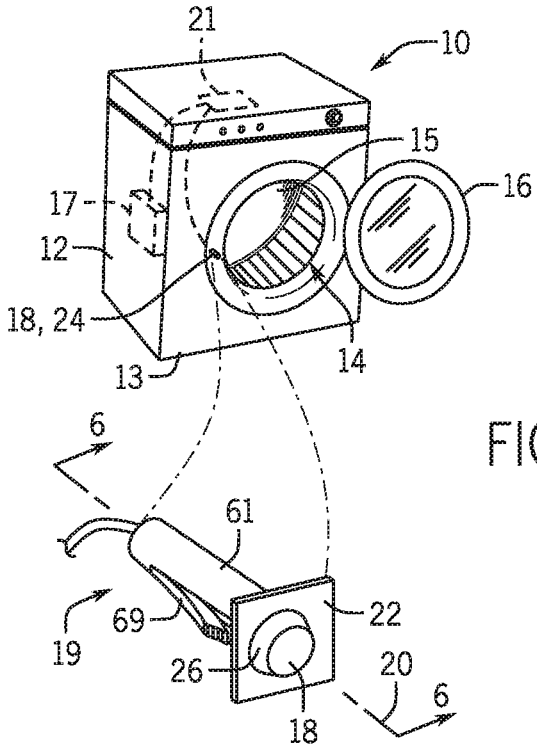
FIG. 1 is a perspective view of a front-loading washing machine suitable for use with the present invention showing an enlarged detail of a pushbutton of an appliance switch extending from a housing of the appliance.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an appliance 10, for example a front-loading washing machine, may provide for a housing 12 having an opening 14 in a front wall 13 for providing a user access to a washing volume 15 of a type well known in the art. The opening 14 may be coverable by a door 16 that may seal against the opening 14 to block the flow of water therethrough. While a washing machine is shown in the following example, the invention may also be used in other appliances subject to contamination including dryers, ovens and dishwashers.

Figure 2:
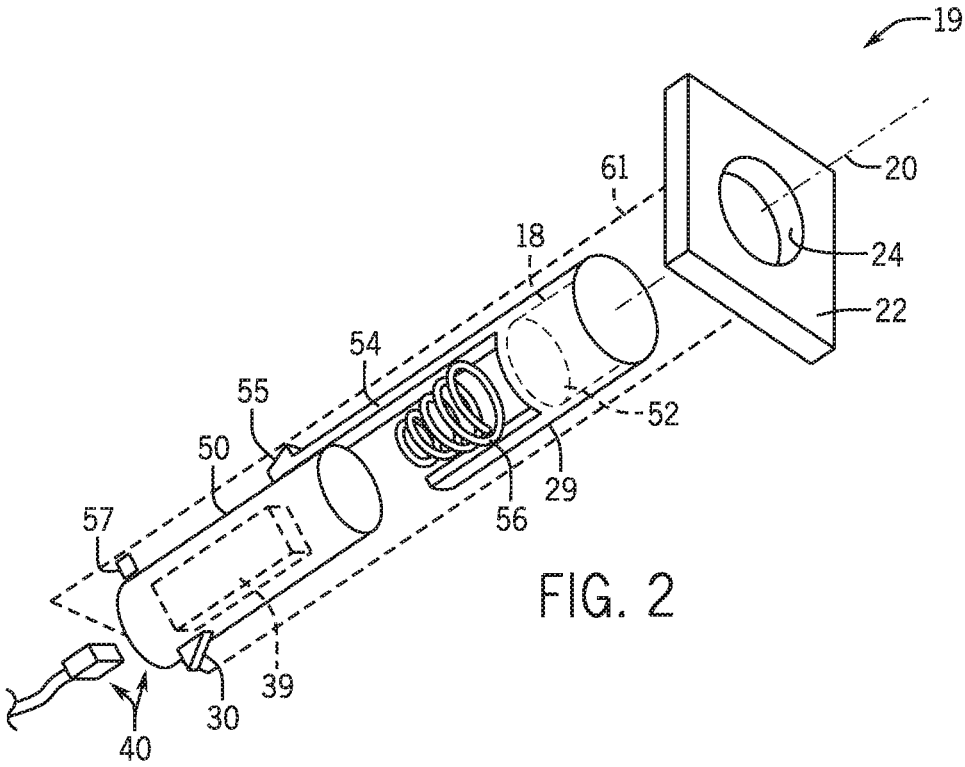
FIG. 2 is an exploded diagram of the appliance switch of FIG. 1 showing the pushbutton as supported by an internal pillar holding a switch mechanism and biased by a conical compression spring and showing an outwardly extending arm member allowing the pushbutton to activate the switch mechanism inside the pillar.

Referring also to FIG. 2, the door 16 may hinge, for example, about a vertical axis at one edge of the door 16 to a side of the opening 14 so that the opposite edge of the door 16 may swing inward covering the opening 14 and pressing inward on a pushbutton 18 of a switch assembly 19, the former protruding from that opposite edge. The pressing inward of the pushbutton 18 of the switch assembly 19 provides an electrical signal to a control system 21 of the appliance 10 indicating closure of the door 16 and normally allowing activation of internal actuators 17 operating elements such as a spin basket/agitator, water valves and the like.

In one embodiment, the switch assembly 19, when installed in the appliance 10 may present a pushbutton 18 movable along a horizontal axis 20 generally perpendicular to a front face of the appliance 10 as actuated by the door 16. The pushbutton 18 may present a generally frustro-conical outer surface axially aligned with the horizontal axis 20 and tapering inward as one moves away from the appliance 10.

The pushbutton 18 may extend through a front faceplate 22 being an integral or connectable part of the switch assembly 19 and, for example, providing an escutcheon that seals against an outer surface of the housing 12. An opening 24 in the faceplate 22 through which the pushbutton 18 extends is sized to be larger than the largest outside diameter of the pushbutton 18 (which, as described above, tapers outwardly to a rear edge). This opening 24 is nevertheless substantially blocked when the pushbutton 18 is fully extended (as shown in FIG. 1) by a rearward taper flare 26 extending radially outward near a rear edge of the pushbutton 18 (closest to the housing 12). This rearward taper flare 26 may be circular or another shape conforming to the opening 24. Alternatively, the rearward taper flare 26 may be a rearward collar on the pushbutton 18.

A guide pillar 50 may extend forward along axis 20 and have a front end adjacent to the opening 24 of the faceplate 22. The guide pillar 50 may have an outer diameter that may fit within an axial bore 52 formed coaxially within the pushbutton 18 and opening rearwardly therefrom. The interfacing surfaces between the pillar 50 and the bore 52 provide the axial guidance of the pushbutton 18 when it is extended and retracted that would otherwise be provided by a tightly fitting outer sleeve which is not employed in the present invention.

The front end of the pillar 50 may abut one end of a conical compression spring 56 fitting between the bottom of the bore 52 and the front end of the pillar 50. The conical compression spring 56 operates to bias the pushbutton 18 to its fully extended outward position in the absence of pressure by the door 16. It will be appreciated that conical compression spring 56 may be compressed substantially flat because of its conical shape.

Referring still to FIG. 2, a lower, rear edge of the pushbutton 18 behind the radially extending rearward taper flare 26 may include a rearwardly directed arm member 29 extending generally parallel to axis 20. The arm member 29 may engage with a contact operator 30 protruding through a wall of the pillar 50 vertically downward from a lower face of the base of the pillar 50. The contact operator 30 as located is depressed upward by rearward motion of the arm member 29 to activate contacts 39 held within the pillar 50.

In this respect, the pillar 50 provides a protective housing for the contacts 39 that shields the contacts 39 from water flowing in a downward direction or rearward direction over the surface of the pillar 50. A point of opening through the pillar 50 where the contact operator 30 extends is located to resist water ingress by being positioned at a rear portion of the pillar 50 removed from the faceplate 22 and being a downward opening that would require water to flow upward to enter the pillar 50.

Electrical connectors 40 communicating with the contacts 39 into a harness, or spade terminals, providing electrical communication with other components of the appliance may be positioned at the rear of the pillar 50 removed from the pushbutton 18 and the flow of water. Key surfaces, not shown, between the bore 52 and the outer surface of the pillar 50 may prevent rotation of the two parts about axis 20.

Figure 3:
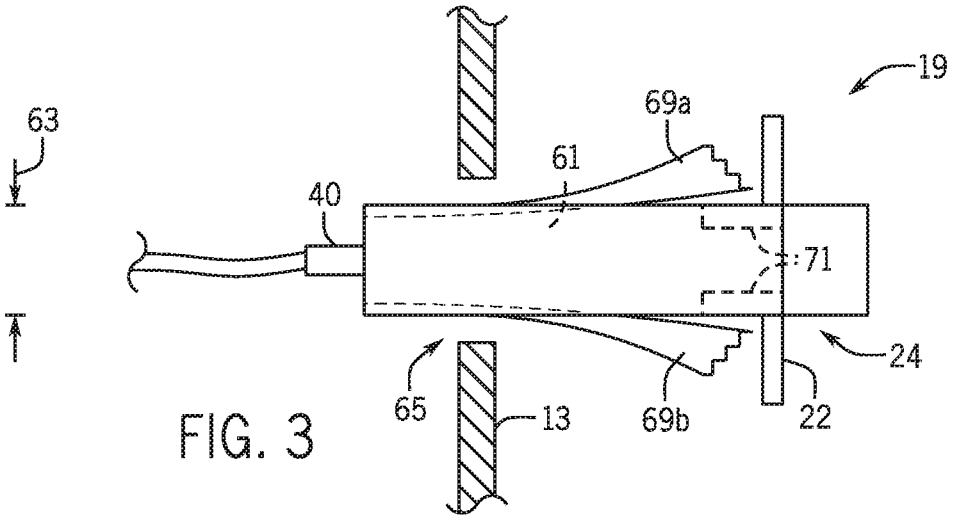
FIG. 3 is a top plan view of the appliance switch of FIG. 2 showing its narrow periphery allowing installation through a hole in a wall of the appliance and further showing retaining arms for holding the pushbutton against an opening in the appliance wall.

Referring now to FIGS. 2 and 3, the pillar 50 will generally be connected to the faceplate 22 by a frame having an outer periphery 63 limited in size to fit through an opening in the front wall 13 of the appliance 10 for installation of the switch assembly 19 from a front of the appliance 10. When so installed, a rear surface of the faceplate 22 abuts a front surface of the wall 13 (shown in FIG. 1) of the appliance 10. The pushbutton 18 and pillar 50 fit within the outer periphery 63.

Left and right cantilevered arms 69a and 69b may attach at a rear end of the frame 61 and, in an unflexed state, may extend outside of the periphery 63. These arms 69 may then flex inward during installation of the switch assembly 19 to allow passage through the opening 65. Once a switch assembly 19 is fully installed, the arms 69 flex outward to abut a rear surface of the wall 13 retaining the switch assembly 19 in position for use. A front facing edge of the arms 69 provide stepped teeth to accommodate different thicknesses of front wall 13.

Figure 8:
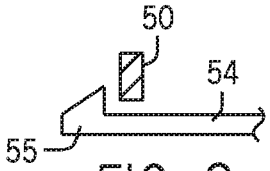
FIG. 8 is a fragmentary detail view of a retention arm limiting extension of the pushbutton.

Referring now to FIGS. 2 and 8, the pushbutton 18 may further have a rearward extending retention arm 54 terminating at a hook 55 that may engage a stop surface 57 attached to the frame 61. Engagement of the hook 55 and the stop surface 57 limit forward travel of the pushbutton 18 at its fully extended position. By displacing this engagement between the hook 55 and stop surface 57 rearward and away from the opening 24, the risk of adhesion between the surfaces caused by contamination is reduced.

Figure 6:
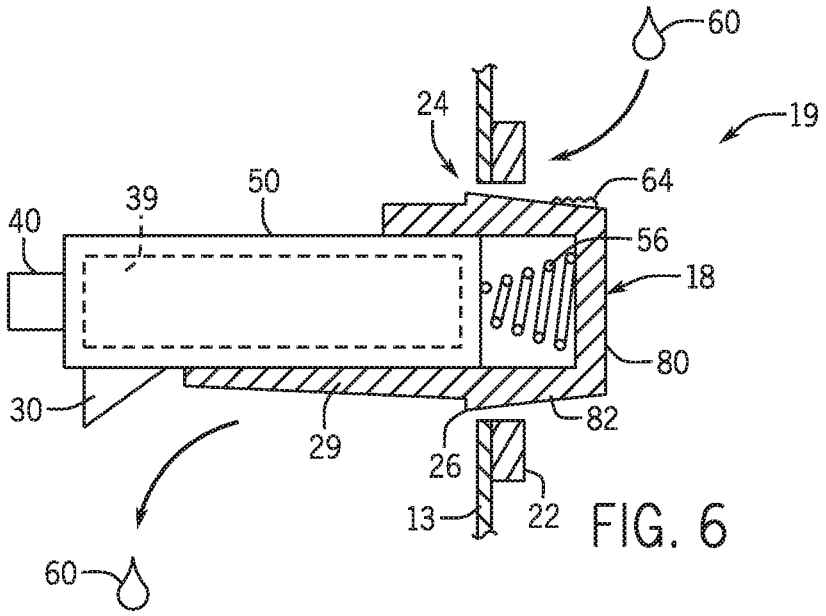
FIG. 6 is a cross-section taken along line 6-6 of FIG. 1 showing the pushbutton in an extended position when an appliance door is open and showing a rearward flaring of the pushbutton and an outwardly extending operator of the switch mechanism not yet actuated by the pushbutton.
Figure 7:
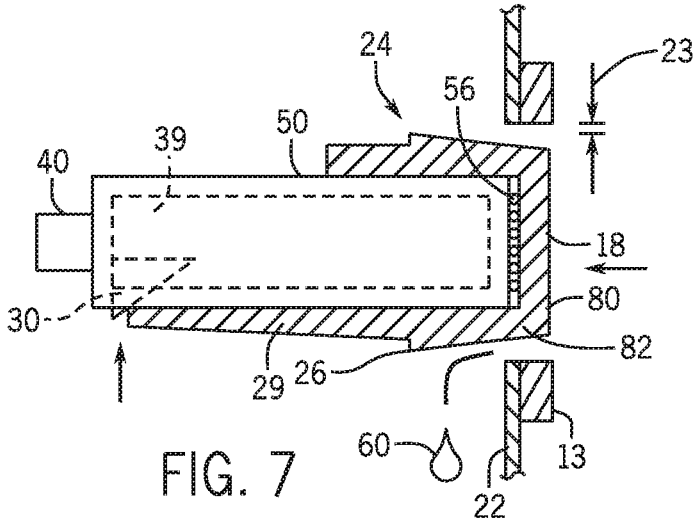
FIG. 7 is a figure similar to that of FIG. 6 showing the pushbutton in a retracted position when the appliance door is closed with the operator depressed radially inward by the pushbutton to activate the switch mechanism.

Referring now to FIG. 6, when the pushbutton 18 is in its fully extended position (limited by the hook 55 and stop surface 57) the rearward taper flare 26 may nearly fill the diameter opening 24 to prevent contamination 60 outside of the appliance 10 from passing into the appliance 10. Nevertheless, contamination 60, for example, bleach or other cleaning products described above, can contact the outer surface of the extended pushbutton 18 and may harden in the form of crystals or the like as surface encrustation 64 which increases the effective diameter 70 of the pushbutton 18 at its outer end. This increase in effective diameter could normally cause jamming of the pushbutton 18 against the inside of the opening 24 but in the present invention the effective diameter of the pushbutton 18 at the site of encrustation 64 will remain below the diameter of the opening 24 during typical use. This is because of the tapered construction of the pushbutton 18 and the fact that the pushbutton 18 need not be guided or supported by the inner diameter of the opening 24 but instead is guided by the outer surfaces of the pillar 50.

Referring momentarily to FIGS. 3 and 6, the pushbutton 18 will have a front surface with skirt walls 82 extending from its outer periphery rearward over the outer wall of the pillar 50 such as defined in the axial bore 52 (shown in FIG. 2). The skirt walls 82 present an unbroken outer surface of the pushbutton 18 throughout its range of travel between fully extended and fully retracted positions beyond the faceplate 22 to further block the ingress of moisture. As discussed above, the sliding engagement between the inner surface of the skirt walls 82 and the outer surface of the pillar 50 guide the pushbutton 18 without the need for sliding contact between the pushbutton 18 and the faceplate 22.

Rearward extension of the skirt walls 82 is limited so that when the pushbutton 18 is fully extended, the skirt walls 82 do not extend into volumes 71 that will receive the cantilevered arms 69 when the cantilevered arms 69 flex inward during assembly of the switch 19 to the appliance 10. After the switch assembly 19 is fully installed and the cantilevered arms 69 return to an outward, unflexed position, the skirt walls 82 may occupy the volume 71 when the pushbutton 18 is depressed to provide additional support for the pushbutton 18. This shared volume also provides a ready indication that that the switch assembly 19 is properly installed in the appliance as indicated by whether or not the operator may be depressed.

Referring still to FIG. 6, when the pushbutton 18 is pressed inward by the door 16, the surface encrustation 64 may pass easily through the opening 24 through an enlarged clearance gap 23 as the rearward taper flare 26 moves back and the spring 56 is compressed. Contamination 60 on the pushbutton 18 or otherwise introduced through the opening 24 at this point in time may wick along the undersurface of the pushbutton 18 but will be prevented from entering the low clearance space between the pillar 50 and the inner bore of the pushbutton 18 by the action of the rearward taper flare 26 which forms a drip ring conducting any such liquid to a lower away from this interface.

Alternative design features are shown in US patent publication 2014/0124342 and hereby incorporated by reference.

It will be appreciated that any contamination that collects between the rearward taper flare 26 and the opening 24, for example, when the pushbutton is fully extended as shown in FIG. 6 will be broken by movement of the pushbutton 18 inward by closing of the door 16 or otherwise will prevent the appliance motor from being activated thus holding the appliance 10 in a safe state.

Figure 4:
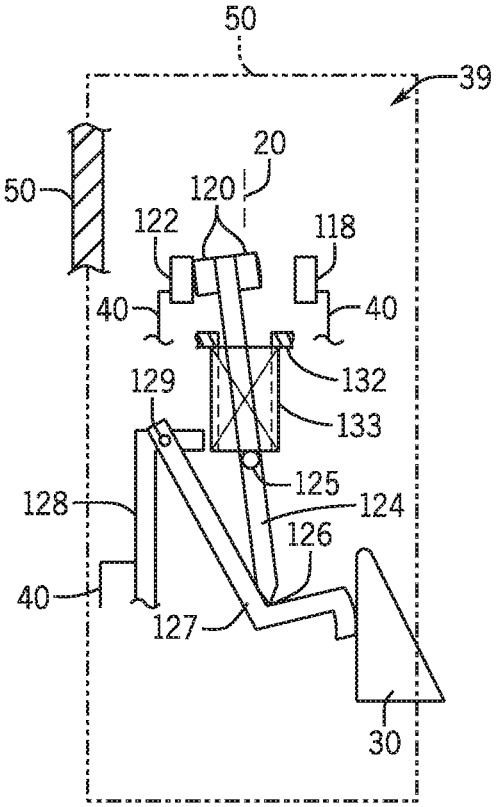
FIG. 4 is a simplified diagram of the switch mechanism with the switch arm member in the un-depressed first state.

Referring now to FIG. 4, the electrical contacts 39 as held within the pillar 50 may contain a right contact 118, a center contact 120, and a left contact 122 arranged to provide a single pole, double throw electrical switch with the right contact 118 and left contact 122 generally flanking the center contact 120. The center contact 120 may move between the right contact 118 and lower contact 120 to selectively and alternatively connect to only one of the right contact 118 and left contact 122.

The center contact 120 may be supported on a relatively rigid conductive lever 124 attached at a knife-edge pivot point 126 to conductive support 127. Conductive support 127 in turn pivots about a captured pivot point 129 on conductive support bracket 128 fixed with respect to the switch housing. The conductive support bracket 128 communicates with one of the electrical connectors 40.

The conductive support 127 may be pivoted leftward (as depicted) by motion of the contact operator 30 inward as will be discussed.

An extension spring (not shown for clarity) extends between an attachment point 125 on the lever 124 and an attachment point 132 on the housing of the switch to draw the two together along line of action 133. This line of action in the configuration shown in FIG. 4 passes to the left side of the pivot point 126 pulling the lever 124 so that contact 120 is pulled against contact 122.

Figure 5:
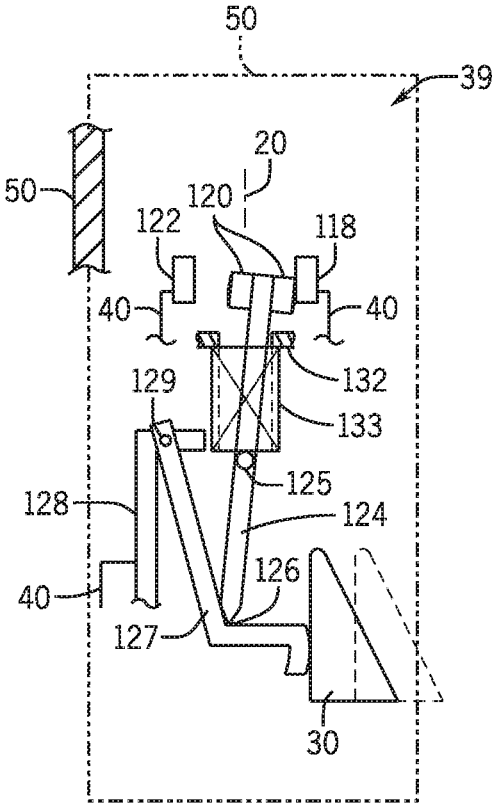
FIG. 5 is a figure similar to FIG. 4 showing the switch mechanism with the switch arm member in the depressed second state.

Referring now to Fig.5, when the contact operator 30 is pressed inward moving the support 127 leftward, the pivot point 126 moves left across the line of action 133 with pressing of the lever 124 against the portion of the support bracket 128 causing the lever 124 to snap rightward so that contact 120 now contacts contact 118. This process is reversed when contact operator 30 is released.

By movement of the support 127, the center contact 120 alternately connects electrically to right contact 118 and left contact 122 in an over-center spring mechanism.

Many of the components of the switch assembly 19 as described above are the subject of co-pending application publication number 2013/0015049 published Jan. 17, 2013, and hereby incorporated in its entirety by reference.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An appliance switch comprising:

a frame having a faceplate with an opening in it and a longitudinal extent having a periphery that may be received along a horizontal axis through a hole in a vertical wall of an appliance with a rear surface of the faceplate abutting a front surface of the vertical wall;

a pushbutton supported by the frame within the periphery to move between an on and off position with respect to the frame along the horizontal axis through the opening in the faceplate as received;

a contact housing supported by the frame within the periphery behind the pushbutton along the horizontal axis as received; and an electrical contacts assembly supported within the contact housing to be shielded by the contact housing from water directed downward across the contact housing or inward through the faceplate as received;

wherein the pushbutton includes an arm member extending from the pushbutton along an outside of the contact housing to a rear lower portion of the contact housing as received; and an operator communicating through the contact housing between the electrical contact assembly and a distal portion of the arm member to activate the electrical contact assembly with movement of the pushbutton.

2. The appliance switch of claim 1 wherein the pushbutton further includes a stop interacting with the frame at a point removed from the faceplate to limit outward motion of the pushbutton.

3. The appliance switch of claim 1 wherein the outer surface of the pushbutton is frusto-conical to taper inward as one moves away from the contact housing.

4. The appliance switch of claim 1 wherein the operator presents a wedge outer surface pressed into the contact housing with rearward motion of the button as received.

5. The appliance switch of claim 1 wherein the operator is positioned at a rear end of the contact housing away from the pushbutton.

6. The appliance switch of claim 1 wherein the frame, pushbutton, contact housing, and operator are constructed of thermoplastic.

7. The appliance switch of claim 1 further including an electrical connector portion and a rear of the contact housing for receiving a releasable electrical connector communicating with the contacts.

8. The appliance switch of claim 1 further including a spring positioned between a front surface of the contact housing facing the pushbutton and a rear surface of the pushbutton facing the contact housing.

9. The appliance switch of claim 8 wherein the spring is a conical spring.

10. The appliance switch of claim 1 further including forwardly extending cantilevered arms attached at a rear of the frame to extend outside of the periphery in an un-flexed state and to flex within the periphery as the frame is received through the hole in the vertical wall of the appliance, the forwardly extending cantilevered arms flexing outward to abut a rear surface of the vertical wall of the appliance when the longitudinal extent of the frame is installed in the hole in the vertical wall.

11. The appliance switch of claim 10 wherein the pushbutton includes rearwardly extending walls providing a continuous surface from a front end of the pushbutton exposed through the opening of the faceplate throughout a range of motion between the on and off position and wherein the rearwardly extending walls prevent inward flexing of the forwardly extending cantilevered arms except when the pushbutton is fully extended.

12. The appliance switch of claim 1 wherein the pushbutton is supported away from contact with the opening in the faceplate when the pushbutton is fully pressed in toward the faceplate.

13. The appliance switch of claim 12 wherein the pushbutton includes rearwardly extending walls providing a continuous surface from a front end of the pushbutton exposed through the opening of the faceplate throughout a range of motion between the on and off position and wherein a front of the contact housing fits within rearwardly extending walls of the pushbutton when the pushbutton is fully pressed in toward the faceplate.

14. The appliance switch of claim 13 wherein an inner surface of the rearwardly extending walls contacts an outer surface of the contact housing to guide motion of the pushbutton as it moves between the on and off position.

15. An appliance comprising:

a housing having a door opening and closing against a vertical wall of the appliance;

an appliance switch position to be activated by closing of the door against the vertical wall the appliance and further comprising:

a frame having a faceplate with an opening in it and longitudinal extent having a periphery that may be received along a horizontal axis through a hole in a vertical wall of an appliance with a rear surface of the faceplate abutting a front surface of the vertical wall;

a pushbutton supported by the frame within the periphery to move between an on and off position with respect to the frame along the horizontal axis through the opening in the faceplate as received;

a contact housing supported by the frame within the periphery behind the pushbutton along the horizontal axis as received; and an electrical contacts assembly supported within the contact housing to be shielded by the contact housing from water directed downward across the contact housing or inward through the faceplate as received;

wherein the pushbutton includes an arm member extending from the pushbutton along an outside of the contact housing to a rear portion of the contact housing as received; and an operator communicating downward through the contact housing between the electrical contact assembly and a distal portion of the arm member to activate the electrical contact assembly with movement of the pushbutton.

16. The appliance of claim 15 wherein the appliance is selected from the group consisting of a washing machine, a dishwasher, an oven and a dryer.

17. The appliance of claim 13 wherein the appliance includes at least one electrical actuator controlled by the contacts.

* * * * *